US005231269A

United States Patent [19]

Oku et al.

[11] Patent Number: 5,231,269

[45] Date of Patent: Jul. 27, 1993

[54] ELECTROMAGNETIC WAVE ENERGY CONVERSION HEAT-GENERATING MATERIAL, HEATING CONTAINER FOR MICROWAVE OVEN, AND MICROWAVE OVEN

[75] Inventors: Mitsumasa Oku, Osaka; Kohei Shiota, Kobe, both of Japan

[73] Assignee: Matsushita Electric Industrial Co., Ltd., Osaka, Japan

[21] Appl. No.: 480,443

[22] Filed: Feb. 15, 1990

[30] Foreign Application Priority Data

Feb. 17, 1989 [JP] Japan ..... 1-38584
Feb. 17, 1989 [JP] Japan ..... 1-38591
Feb. 17, 1989 [JP] Japan ..... 1-38595

[51] Int. Cl.[5] ..... H05B 6/80

[52] U.S. Cl. ..... 219/10.55 F; 219/10.55 E; 426/107; 426/234; 99/DIG. 14; 428/614

[58] Field of Search ..... 219/10.55 E, 10.55 F; 426/107, 241, 243, 234, 109; 99/DIG. 14; 428/614; 126/390

[56] References Cited

U.S. PATENT DOCUMENTS 2,267,720 12/1941 Cyr et al. .
2,331,599 10/1943 Cyr .
4,864,089 9/1989 Tighe et al. ..... 219/10.55 F
4,876,423 10/1989 Tighe et al. ..... 219/10.55 E
4,883,936 11/1989 Maynard et al. ..... 219/10.55 F
4,960,654 10/1990 Yoshinaka et al. ..... 428/614

FOREIGN PATENT DOCUMENTS 0325797 8/1989 European Pat. Off. .
2612033 9/1988 France .
2186478 8/1987 United Kingdom .

*Primary Examiner*—Philip H. Leung
*Attorney, Agent, or Firm*—Lowe, Price, LeBlanc & Becker

[57] ABSTRACT

An electromagnetic wave energy conversion heat-generating material comprising zinc oxide whisker used as a heat-generating material. A heating container for an electronic oven, comprising the zinc oxide whiskers, and a microwave oven provided with a heat generator comprising the zinc oxide whiskers. The present electromagnetic wave energy conversion heat-generating material generates heat upon exposure to microwaves. In a preferred embodiment, the zinc oxide whiskers include a central part and needle crystal projections extending from the central part in plural, preferable four, different axial directions.

25 Claims, 2 Drawing Sheets

100 µm

100 µm

ELECTROMAGNETIC WAVE ENERGY CONVERSION HEAT-GENERATING MATERIAL, HEATING CONTAINER FOR MICROWAVE OVEN, AND MICROWAVE OVEN

BACKGROUND OF THE INVENTION

1. Field of the Invention

This invention relates to an electromagnetic wave energy conversion heat-generating material, a heating container for a microwave oven, and also a microwave oven. More particularly, it relates to an electromagnetic wave energy conversion heat-generating material, a heating container for a microwave oven, and also a microwave oven, all having a very high heat conversion efficiency and a superior durability.

2. Description of the Prior Art

Electromagnetic wave energy conversion heat-generating materials include those in which dielectric loss or magnetic loss is utilized and those in which a resistance material is utilized. Of these, ferrite-type heat-generating materials have been commonly used as the heat-generating materials that utilize the magnetic loss. On the other hand, the heat-generating materials comprising a resistance material have been often used in view of their heat generation efficiency, lightness in weight, cost, etc.

As specific resistance materials, carbon types (powder, fibers, whiskers, sinters, etc.) are most widely used. In these days, however, studies have been made on silicon carbide types (fibers, whiskers, powder, sinters, etc.), or materials comprising insulating fibers or whiskers (such as potassium titanate whiskers) whose particle surfaces have been made conductive (by reduction or by coating with a conductive substance), as well as conductive metal oxides (powder, sinters, etc.) such as conductive zinc oxide.

The carbon-type heat-generating materials, however, are disadvantageous in that the oxidation of carbon proceeds to become subject to combustion, and hence have been questioned on their safety and durability.

The silicon carbide types are expensive and have problems on the stability on heat generation. The conductive zinc oxide also have problems on heat generation efficiency.

The materials whose particle surfaces have been made conductive are commonly involved in the problem that the heat generation performance is deteriorated with time.

SUMMARY OF THE INVENTION

The present invention has been accomplished as a result of intensive studies made on account of the above problems. Thus, an object thereof is to provide an electromagnetic wave energy conversion heat-generating material having superior durability and electromagnetic wave energy conversion heat generation efficiency, and moreover being non-flammable, capable of overheat display (color changing) also, and having high safety.

As a result of the intensive studies, the present inventors have discovered that all the above performances can be achieved by the means as described below, using really novel zinc oxide whiskers as the electromagnetic wave energy conversion heat-generating material.

The present invention is an electromagnetic wave energy conversion heat-generating material comprising zinc oxide whiskers used as a heat-generating material.

In a preferred embodiment, the electromagnetic wave energy conversion heat-generating material comprises aggregated zinc oxide whiskers or zinc oxide whiskers dispersed in a holding material used as a heat-generating material which are not less than 10 μm in length from the base to the top of each zinc oxide whisker.

In a still preferred embodiment, the electromagnetic wave energy conversion heat-generating material comprises zinc oxide whiskers with the structure comprising a central part and needle crystal projections extending from said central part in plural different axial directions.

In a still preferred embodiment, the electromagnetic wave energy conversion heat-generating material comprises zinc oxide whiskers used as a heat-generating material, wherein the number of axis is 4, of the above needle crystal projections extending in plural different axial directions (hereinafter "tetrapod structure".

The present invention also provides a heating container for a microwave oven, which comprises an electromagnetic wave energy conversion heat-generating material comprising zinc oxide whiskers disperse in a matrix.

The present invention still also provides a microwave oven provided in its heating chamber or space with the above electromagnetic wave energy conversion heat generator and/or the above heating container for a microwave oven.

The present electromagnetic wave energy conversion heat-generating material generates heat upon exposure to microwaves. This heat-generating material comprises the zinc oxide whiskers as summarized above and will be detailed below. When used, the zinc oxide whiskers are mixed into rubber or plastic materials or ceramic materials, and formed into desired shapes.

The zinc oxide whiskers are semiconductors, where individual whiskers come into contact with each other because of their morphological features, to form a mesh-like heat generator structure. Hence, the heat-generating material can efficiently convert microwave energy to heat, thus generating heat.

The container for an electronic oven, comprised of the above heat-generating material, in which objects to be heated, as exemplified by food and water, have been put may be put in a heating chamber of a microwave oven and then may be exposed to microwaves, so that the container itself generates heat to effect heating in a short time.

In the microwave oven provided with a heat generator comprised of the above heat-generating material, food or the like is heated upon exposure to microwaves and at the same time heated with the above heat generator that generates heat upon exposure to microwaves, so that the food or the like can be heated in a good efficiency.

DETAILED DESCRIPTION OF THE PREFERRED EMBODIMENTS

Figure 1:
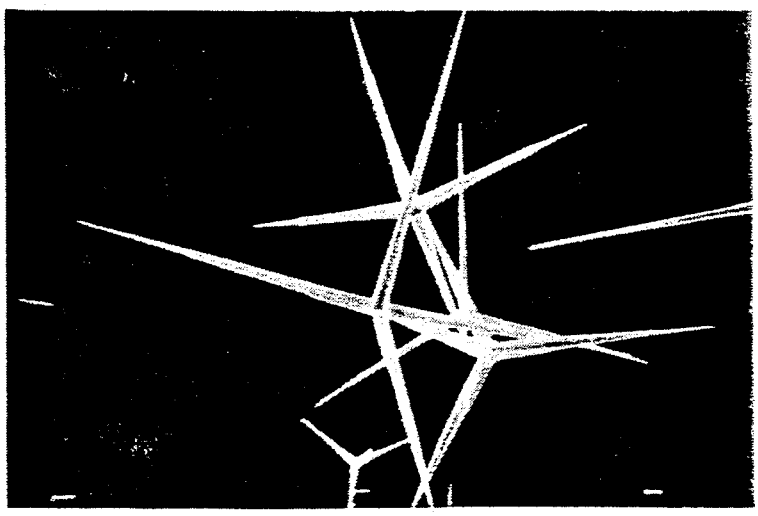
FIGS. 1 and 2 are electron micrographs to show crystal shape of zinc oxide whiskers used in the electromagnetic wave energy conversion heat-generating material of the present invention.

The electromagnetic wave energy conversion heat-generating material that employs zinc oxide whiskers can effect heat conversion in a much higher efficiency than that of the conventional materials. Although the mechanism thereof has not still been well clarified, it is presumed at present time as follows:

FIG. 1, an electron micrograph, first of all shows an example of the zinc oxide whiskers used in the present invention.

The zinc oxide whiskers (hereinafter "ZnO whiskers") are metal oxides, formed of single crystals which are conspicuously complete among many types of whiskers. They have excellent gloss on their surfaces. From a crystallographic view, excessive Zn atoms act to promote the conductivity of the whisker itself, so that the whole part of the whisker is semiconductive. Hence, the whole single crystals of whiskers can form a thoroughly uniform heat-generating material, giving a highly efficient heat-generating material. The whiskers of this type are also very unique in their shapes. They have three dimensional structure of tetrapod shape, and can readily form a three-dimensional mesh structure when they have aggregated, giving a structure of loop antennas. It can be also presumed that the sharp tops of the whiskers contribute to highly efficient heat generation. This whiskers are formed of single crystals which are colorless and transparent, and the respective whiskers are very right and have little irregularities on their surfaces, giving very unusually excellent whiskers. Because of this unique three-dimensional mesh structure and the properties inherent in ZnO whiskers, electromagnetic waves can be effectively led to the inside of the heat-generating material and hence electromagnetic wave energy can be effectively converted to heat.

The present ZnO whiskers can also well absorb light, with very high photoconductive properties, and are greatly different from many other whiskers. Moreover, ZnO is a material that uniquely behaves even in a magnetic environment. For example, it can exhibit unique magnetic properties when it is mixed into various ferrites. It is also a material that shows diamagnetism, having a magnetic susceptibility of $-0.31\times10^{6}/0°$ C. (c.g.s. unit), which therefore can promise a magnetic effect. Namely, the crystal, morphological, conductive and magnetic properties characteristic of the ZnO whiskers are presumed to collectively act to convert the electromagnetic wave energy to heat in a much higher efficiency than the conventional heat-generating materials.

Since the ZnO whiskers are metal oxides, they are free from the progress of oxidation or the combustion even when overheated, thus giving a heat-generating material having superior durability and safety.

In addition, ZnO undergoes a color change (retroactive) from white into yellow, thus giving a heat-generating material endowed with a function of overheat display.

The ZnO whiskers used in the present invention is endowed with the properties of generating heat at an unparallel strength upon exposure to radio waves (2.45 GHz) of a microwave oven. Hence, a container may be provided with the ZnO whiskers on at least part hereof, thereby giving a container that can be readily heated (or generate heat) in a microwave oven.

Any objects, when heated using this container, can therefore be heated in a very short time and yet with uniformity.

The microwave oven of the present invention is provided at an appropriate position and form in a microwave oven, with a heat generator (a heater) that comprises the above ZnO whiskers as the heat-generating material and generates heat by itself upon exposure to radio waves, and hence it follows that objects (foods) to be heated in the oven are simultaneously heated by the ratio waves and the heater, in the microwave oven. This brings about the advantages that cooking time can be shortened, objects to be heated can be uniformly heated through their surfaces to insides, and features attributable to external heating that gibes a "browned surface" or the like can be added.

Setting the heat generator in a given form and at a given position also makes it possible to locally heat the objects to be heated or heat a liquid at a high speed. Thus, the present heat-generating material has very wide uses.

The electromagnetic wave energy conversion heat-generating material is comprised of a material that can convert radio wave (or electromagnetic wave) energy to heat in a high efficiency, and the ZnO whiskers are most suitable therefore particularly in view of heat generation efficiency.

In particular, a heat-generating material comprising ZnO whiskers not less than 10 μm in length from the base to the top of each zinc oxide whisker is particularly excellent in properties such as heat generation efficiency.

Among such whiskers, a heat-generating material comprising ZnO whiskers having the tetrapod shape has excellent heat generation efficiency, and is most suitable as the electromagnetic wave energy conversion heat-generating material used for microwave ovens. In addition, zinc oxide is an excellent material also in view of safety and health, and is a remarkable material among other conventional heat-generating materials.

The present invention will now be described below by giving more specific embodiments. The present invention, however, is by no means limited to these.

In the present invention, really novel ZnO whiskers are used in the electromagnetic wave energy conversion heat-generating material. Among the ZnO whiskers, ZnO whiskers with the tetrapod shape (FIG. 1) are particularly remarkable in view of their characteristics.

Figure 2:
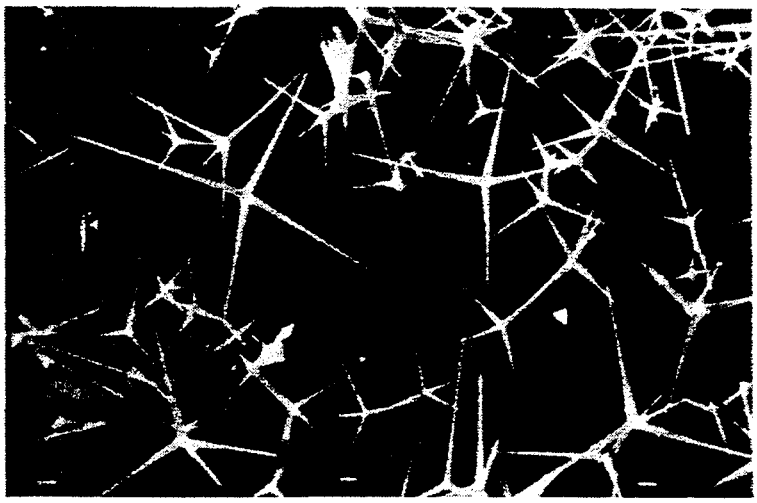

The ZnO whiskers of this type can be formed by subjecting metallic zinc powder having oxide layers on its particle surfaces, to heat treatment in an oxygen-containing atmosphere. The tetrapod-like ZnO whiskers thus obtained have an apparent bulk density of from 0.02 to 0.3, and can be very readily mass-produced in a yield of not less than 70 wt. %. FIGS. 1 and 2 are electron micrographs of the whiskers, demonstrating an example of the product thus formed. As will be seen therefrom, the morphological and dimensional features are previously described can be clearly recognized.

Incidentally, in some tetrapod-like ZnO whiskers, those having the needle crystal projections of three axes, two axes and also one axis are mixed. They, however, are those in which part of originally four-axial crystals has been broken. When the tetrapod-like ZnO whiskers are mixed in rubber, resin, ceramics, glass or the like, it may often occur that the whiskers are broken to lose their shapes when they are blended, resulting in their changes into simple needle whiskers.

X-ray diffraction patterns taken on the present tetrapod-like ZnO whiskers showed peaks of ZnO in all instances. Results of electron diffraction also showed monocrystallinity with less transition and lattice defects. Impurities were also in so a small content that ZnO was found to comprise 99.98% as a result of atomic-absorption spectroscopy.

A system in which ZnO whiskers of less than 10 μm in lengths at the needle crystal projections hold a greater proportion (e.g., not less than 95 wt. %) is not preferred in view of the electromagnetic wave energy conversion efficiency. Preferably, it is desirable to use not less than 3 wt. % of ZnO whiskers of not less than 50 μm in lengths at the needle crystal projections, and more preferably, not less than 70 wt. % of ZnO whiskers of not less than 80 μm in lengths at the needle crystal projections. On the other hand, ZnO whiskers of not more than 300 μm in lengths are suited for mass production.

The ZnO whiskers should preferably have an aspect ratio of not less than 10 on the average.

The ZnO whiskers used in the present invention can have a resistivity within the range of from 10 to $10^8\Omega\cdot$cm in a pressed powder state (5 kg/cm$^2$), which may be selected depending on the purpose. The ZnO whiskers, however, may preferably have a resistivity of from $10^2$ to $10^6\Omega\cdot$cm in view of the height of energy conversion efficiency and the practical utility, and particularly effectively from $1.0\times10^4$ to $1.0\times10^5\Omega\cdot$cm when the production process and production cost are taken into account. The resistivity can also be varied depending on firing conditions, by reduction-firing, or by doping with other elements as exemplified by Al, Li and Cu according to a suitable method.

The electromagnetic wave energy conversion heat-generating material of the present invention can be used in various forms. More specifically, it can be used in the state of a powder of ZnO whiskers, the state of a deposit thereof, and the state of a sinter thereof, as well as the state in which ZnO whiskers are dispersed in resins, rubbers, ceramics, glasses, coating materials, and so forth.

The ZnO whiskers in the state of a powder can be used as the heat-generating material in such a form that they are put in a solid container made of ceramics, glasses, resins, rubbers, etc. or they are enveloped with these materials, or that they are contained in a liquid such as water or oil or present together with the liquid.

The ZnO whiskers in the state of a deposit refer to ZnO whiskers formed into whisker papers by paper-making methods, or ZnO whisker deposits formed by filtration according to wet filtration (such as vacuum filtration). In this instance, suitable organic or inorganic binders can be used. In particular, use of the inorganic binder having excellent thermal resistance can bring about good results.

The ZnO whiskers in the form of a sinter can also be used, which is obtained by sintering at a suitable temperature (from 500° to 1,600° C.) an aggregate of ZnO whiskers while pressing it or after pressing it, under a suitable pressure. In this instance, it is effective to use a suitable amount of a sintering aid commonly used. There are no particular limitations on the pressure for the pressing, but the pressing may be carried out within the pressure range of from 1 to 2,000 kg/cm$^2$, and particularly from 10 to 500 kg/cm$^2$ to give good results.

The ZnO whiskers may also be dispersed in a matrix of various types to form a heat generator. Resins used as the matrix can be selected depending on purpose, from those having high thermal resistance, including superengineering plastics and general-purpose engineering plastics.

Specifically, both thermosetting resins and thermoplastic resins can be used.

Regarding the thermosetting resins, usable resins include epoxy resins, unsaturated polyester resins, urethane resins, silicone resins, melamine-urea resins, and phenol resins.

Regarding the thermoplastic resins, usable resins include polyvinyl chloride, polyethylene, chlorinated polyethylene, polypropylene, polyethylene terephthalate, polybutylene terephthalate, polyamide, polysulfone, polyetherimide, polyethersulfone, polyphenylene sulfide, polyether ketone, polyether ether ketone, ABS resin, polystyrene, polybutadiene, methyl methacrylate, polyacrylonitrile, polyacetal, polycarbonate, polyphenylene oxide, an ethylene/vinyl acetate copolymer, polyvinyl acetate, an ethylene/tetrafluoroethylene copolymer, aromatic polyesters, polyvinyl fluoride, polyvinylidene fluoride, polyvinylidene chloride, and Teflon.

The rubber material used as the matrix may include natural rubbers and synthetic rubbers. In particular, rubbers having excellent thermal resistance can bring about good results.

In this regard, silicone rubbers are most suitable. What are secondly suitable include acrylic rubbers, which can bring about good results. What are thirdly suitable include butadiene rubbers, isobutylene rubbers, urethane rubbers, and isocyanate rubbers. Chloroprene rubbers and fluorine rubbers can also be used depending on the uses.

In these rubbers, the ZnO whiskers are dispersed by kneading and stirring, followed by the means such as molding or casting to form the heat generator.

The ZnO whiskers may also be dispersed in coating materials of various types to give a coating material heat-generating material.

The ZnO whiskers may still also be dispersed in inorganic solid materials of various types (powdery, fibrous, flaky, granular or solid) that serve as holding materials, thereby forming the heat generator.

Stated specifically, there can be formed a solid heat generator comprising the ZnO whiskers dispersed in glasses, enamels, ceramics of various types, etc., or a heat-generating powder, a heat-generating fibrous aggregate, etc. comprising the ZnO whiskers dispersed in powdered clay, glass fiber, asbestos, mica, sand or the like.

In these systems in which the ZnO whiskers are used in dispersed states, the heat generation effect can be satisfactorily exhibited when at least about 5 wt. % of ZnO whiskers are dispersed, though variable depending on the magnitude of electromagnetic wave energy, size of ZnO whiskers, materials for matrices, and types of holding materials. The effect becomes remarkable when at least 10 wt. % of ZnO whiskers are dispersed.

In some instances, it is also possible to use other electromagnetic wave energy conversion heat-generating materials (including carbon powder or fiber, silicon carbide powder or whiskers, ferrite powder, and metal powder or fiber) by mixture or in combination.

There are no limitations on the frequency and intensity of the electromagnetic waves upon exposure to which the heat-generating material of the present invention generates heat, so long as the heat can be efficiently and effectively generated. Specifically, the heat-generating material can be effectively used in a high-frequency dielectric heating oven or microwave oven (2.45 GHz) or an incinarator.

As the container for a microwave oven, the ZnO whiskers can be used in various forms. More specifically, the ZnO whiskers are dispersed in various matrices, then molded into a dish, a bowl, a teacup, a sake bottle, an earthen pot, a glass, etc. Earthenware, porcelain, glass, enamel, and plastics are used as the matrices. It is also possible to provide a coating on the inner or outer surface of the container, using an organic or inorganic coating material.

EXAMPLES

The present invention will be described below in greater detail by giving Examples.

Example 1

ZnO whiskers, formed by the method as previously described, were 80 to 150 μm in the distribution of lengths from the bases to the tops and 0.3 to 2.5 μm in that of diameters at the bases, and most of the whiskers had the tetrapod shapes.

Part of the ZnO whiskers thus formed was collected, and held between parallel flat electrodes (silver-plated; electrode areas: 2 $cm^2$ each), followed by pressing at 5 $kg/cm^2$. The resulting ZnO whiskers had a layer thickness of 200 μm, through which a current of 300 mA flowed under an applied voltage of DC 60 V. In other words, as a result of the pressing at 5 $kg/cm^2$, the product was found to be ZnO whiskers having a resistivity of $2\times10^4\Omega\cdot cm$ in a pressed powder state. At this time, the indoor atmosphere had been kept at 20° C. and 35% RH.

The resulting ZnO whiskers were thoroughly dispersed in distilled water with gentle stirring, and then subjected to vacuum filtration to completely remove water content. A filtration deposit of 30 mm thick was thus obtained, and was then not-air dried at 150° C. for 12 hours. Thereafter, the product was cut out to a size of 25 mm cube. The sample thus obtained was put in a microwave oven (manufactured by Matsushita Electric Industrial Co. Ltd; NE-M315; 500 W) and placed on an alumina ceramic plate provided at the center. An electric source was put on. As a result, the sample became red hot after at least 30 seconds, and was found to have been made into a complete heat-generating material. This sample was taken out to find that it had turned yellow, but, once it was cooled in the atmosphere, its color suddenly returned to original white.

Example 2

The same ZnO whiskers as in Example 1 were collected, and pressed under a pressure of 100 $kg/cm^2$. A pellet sample of 5 mm thick was thus obtained. This sample was fired at 1,350° C. for 6 hours to give a sinter. After cooled, using the same microwave oven as in Example 1, the sinter was placed on an alumina ceramic plate provided at the center. An electric source was put on, and then the sample was taken out after 1 minute. As a result, the sample had turned yellow, showing that it generated heat of 300° C. or more. Its color returned to white as it was cooled in the atmosphere. On the other hand, the alumina ceramic plate beneath the sample was in a heated state to the extent that it felt a little warm when touched. Thus, this sinter was found to have been undoubtedly made into a complete heat-generating material.

Example 3

ZnO whiskers, formed by the same method as in Example 1, were 50 to 100 μm in the distribution of lengths from the bases to the tops and 0.2 to 0.8 μm in that of diameters at the bases, and most of the whiskers had the tetrapod shapes. The whiskers were kneaded (in an amount of 21.5 wt. %) into a polypropylene resin, and the kneaded product was injection molded to give a plate-like sample of 3 mm thick (10 cm square). This sample was exposed to radio waves for 20 seconds in the same microwave oven as used in Example 1. As a result, the surface temperature of the sample rose to 72° C. On the other hand, the surface temperature of a polypropylene plate prepared for comparison, having the same shape but incorporated with no ZnO whiskers, was found to be 33° C.

Example 4

Various powders as shown in Table 1 were each collected in a 100 cc beaker in an amount of 100 cc (not particularly pressed), which were then exposed to radio waves for 20 seconds in the same microwave oven as used in Example 1. As a result, it was found that ZnO whiskers with larger size brought about particularly greater heat generation. The temperature was measured in the following way: Immediately after the beaker was taken out of the microwave oven, a maximum thermometer (7 mm in diameter) was inserted to the center of the beaker, and its graduation was read.

Example 5

The same ZnO whiskers as used in Example 1 were mixed into clay, and softly kneaded so as to be well dispersed. Here, the ZnO whiskers were mixed in an amount of 25 wt. %. The resulting clay composition was formed into a container of 5 mm in wall thickness, 10 cm in height and 360 ml in internal volume, which was then fired to give a finished container.

Into this container, 360 ml of water was poured, and then heated in a microwave oven (500 W). As a result, the time taken until the water temperature rose by 30° C. was 39% shorter on the average than the case of a container incorporated with no ZnO whiskers. Moreover, the container showed very high heat retaining properties.

TABLE 1

| Powder | Powder particle size (μm) | Pressed powder resistivity[1)] (Ω · cm) | Temp. (°C.) |
|---|---|---|---|
| Example: | | | |
| (1) ZnO whiskers with tetrapod shape | 100 to 200* | $1.2\times10^4$ | 201 (red hot) |
| (2) ZnO whiskers with tetrapod shape | 10 to 70* | $8\times10^4$ | 151 (red hot) |
| Comparative Example: | | | |
| (3) Silicon carbide whiskers | 10 to 20** | $5\times10^3$ | 79 |
| (4) ZnO whiskers with tetrapod shape | 2 to 8* | $6\times10^6$ | 43 |
| (5) Zinc oxide | 0.52*** | $10^8$ | 24 |
| (6) Conductive zinc oxide | 1.1*** | 120 | 60 |

[1)] 5 $kg/cm^2$ · t = 0.2 to 1 mm
*Projection length
**Length
***Particle diameter (average)

Example 6

The sane ZnO whiskers as used in Example 1 were thoroughly softly dispersed in water, and then subjected to vacuum filtration. A filtration deposit of 2 cm thick was thus obtained. This product was dried at 150° C. for 15 hours to give a heat generator.

Figure 3:
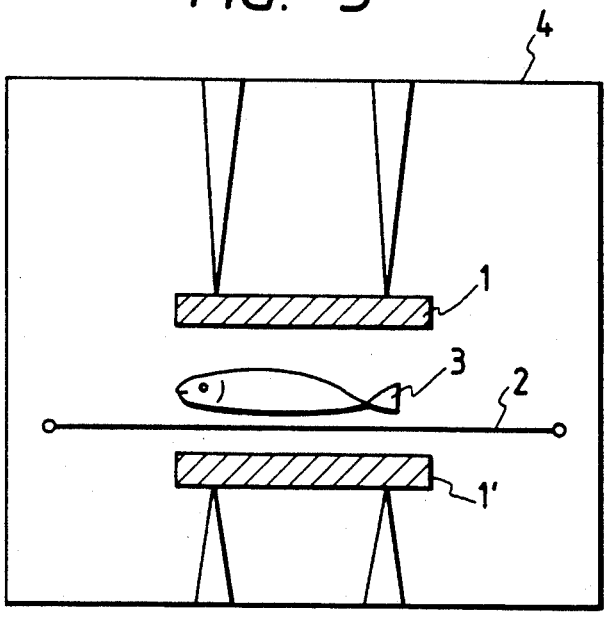
FIGS. 3 and 4 are cross sections of microwave ovens according to examples of the present invention.

The resulting heat generator was then set in a microwave oven as shown in FIG. 3. In FIG. 3, the numerals 1, 1' each denote the heat generator; 2, a holder for an object to be heated; 3, an object to be heated; and 4, the microwave oven. Meat or fish was broiled or roasted. As a result, there were obtained the same effects as the external heating that uses charcoal fire, and it was possible to give the "browned surface" or the like. In this way, it was found that the heat generator showed very good cooking performance.

Here, the heat generator was also seen to have turned red hot in the microwave oven.

Example 7

The same ZnO whiskers as used in Example 1 were mixed into clay, and softly kneaded so as to be well dispersed. Here, the ZnO whiskers were mixed in an amount of 30 wt. %. Using the resulting clay composition, balls of 2 mm in diameter were prepared, which were then fired to give earthenware ball-like heat-generating materials.

Figure 4:
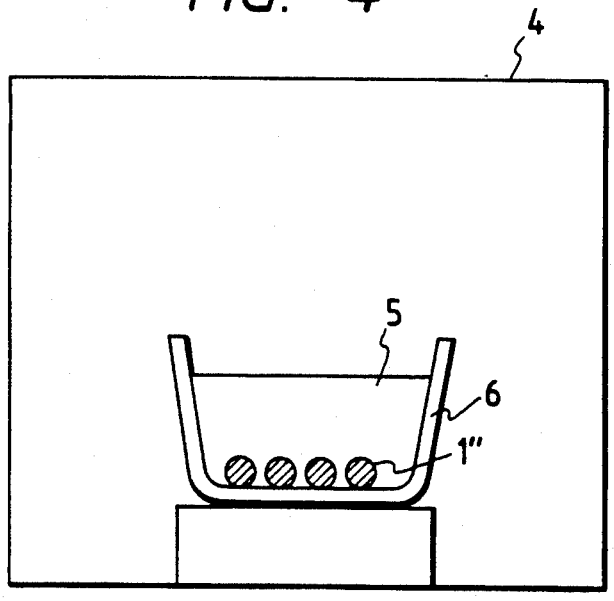

In a container holding 1 l of water, 10 pieces of the resulting heat-generating materials were put and then heated. As a result, the temperature was found to rise (by 40° C.) 25% earlier on the average than the case in which no heat-generating material was used. In FIG. 4, the numeral 1'' denotes the heat-generating material; 4, a microwave oven; 5, water; and 6, the container.

As having been described in the above, the present invention can effect the following:

In these days, microwave ovens have come into wide use in homes, and high-frequency heating techniques have also been applied everywhere. Under such circumstances, highly efficient electromagnetic wave energy conversion heat-generating materials have been strongly sought for various purposes. In the future, very highly efficient electromagnetic wave energy conversion heat-generating materials will also become indispensable for realizing radio wave transfer of energy. In this sense, the present invention can be of wide application, having a very great industrial utility.

What is claimed is:

1. An electromagnetic wave energy conversion heat-generating material comprising zinc oxide whiskers in an aggregated form or dispersed in a matrix, said zinc oxide whiskers being not less than 10 μm in length from a base portion of each whisker to a top portion of each whisker and having a resistivity of from 10 to $10^8\Omega\cdot$cm, and said matrix being at least one selected from the group consisting of ceramics, glasses, enamels, resins, rubbers, organic coating materials, inorganic coating materials, clay, mica, sand, earthenware, porcelain, water and oil.

2. An electromagnetic wave energy conversion heat-generating material according to claim 1, wherein said zinc oxide whiskers comprises a crystal comprised of a central part and a needle crystal projections extending from said central part in plural different axial directions.

3. An electromagnetic wave energy conversion heat-generating material according to claim 2, wherein said zinc oxide whiskers contains not less than 3 wt. % of whisker components of not less than 50 μm in lengths at the needle crystal projections.

4. An electromagnetic wave energy conversion heat-generating material according to claim 2, wherein said zinc oxide whiskers contains not less than 70 wt. % of whisker components of not less than 80 μm in lengths at the needle crystal projections.

5. An electromagnetic wave energy conversion heat-generating material according to claim 2, wherein said zinc oxide whiskers comprises a crystal comprised of a central part and needle crystal projections extending from said central part in four different axial directions.

6. An electromagnetic wave energy conversion heat-generating material according to claim 5, wherein said zinc oxide whiskers contains not less than 3 wt. % of whisker components of not less than 50 μm in lengths at the needle crystal projections.

7. An electromagnetic wave energy conversion heat-generating material according to claim 5, wherein said zinc oxide whiskers contains not less than 70 wt. % of whisker components of not less than 80 μm in lengths at the needle crystal projections.

8. An electromagnetic wave energy conversion heat-generating material according to claim 1, wherein said zinc oxide whiskers have a resistivity of from $10^2$ to $10^6$ $\Omega\cdot$cm.

9. A heating container for a microwave oven comprising means for supporting a material to be heated in a microwave oven at least part of said supporting means is composed of an electromagnetic wave energy conversion heat-generating material comprising zinc oxide whiskers dispersed in a matrix, said zinc oxide whiskers being not less than 10 μm in length from a base portion of each whisker to a top portion of each whisker and having a resistivity of from 10 to $10^8\Omega\cdot$cm, and said matrix being at least one selected from the group consisting of ceramics, glasses, enamels, resins, rubbers, organic coating materials, inorganic coating materials, clay, mica, sand, earthenware, porcelain, water and oil.

10. A heating container for an electronic oven according to claim 9, wherein said zinc oxide whiskers comprises a crystal comprised of a central part and needle crystal projections extending from said central part in plural different axial directions.

11. A heating container for an electronic oven according to claim 10, wherein said zinc oxide whiskers contains not less than 3 wt. % of whisker components of not less than 50 μm in lengths at the needle crystal projections.

12. A heating container for an electronic oven according to claim 10, wherein said zinc oxide whiskers contains not less than 70 wt. % of whisker components of not less than 80 μm in lengths at the needle crystal projections.

13. A heating container for an electronic oven according to claim 9, wherein said whiskers come into contact with each other to form a mesh-like heat generator structure.

14. A heating container for an electronic oven according to claim 9, wherein said zinc oxide whiskers have a resistivity of from $10^2$ to $10^6\Omega\cdot$cm.

15. A heating container for an electronic oven according to claim 9, wherein said heat-generating material is comprised of zinc oxide whiskers and a structural material from which said container is formed.

16. A heating container for an electronic oven according to claim 9, wherein said heat-generating material is comprised of zinc oxide whiskers and a heat-resistant material.

17. A microwave oven having a heating chamber with an electromagnetic wave energy conversion heat generator provided within said heating chamber, said electromagnetic wave energy conversion heat generator comprising zinc oxide whiskers in an aggregated form or dispersed in a matrix, said zinc oxide whiskers being not less than 10 μm in length from a base portion of each whisker to a top portion of each whisker and having a resistivity of from 10 to $10^8\Omega\cdot$cm, and said matrix being at least one selected from the group consisting of ceramics, glasses, enamels, resins, rubbers, organic coating materials, inorganic coating materials, clay, mica, sand, earthenware, porcelain, water and oil.

18. A microwave oven according to claim 17, wherein said zinc oxide whiskers comprises a crystal comprised of a central part and needle crystal projections extending from said central part in plural different axial directions.

19. A microwave oven according to claim 18, wherein said zinc oxide whiskers contains not less than 3 wt. % of whisker components of not less than 50 μm in lengths at the needle crystal projections.

20. A microwave oven according to claim 18, wherein said zinc oxide whiskers contains not less than 70 wt. % of whisker components of not less than 80 μm in lengths at the needle crystal projections.

21. A microwave oven according to claim 17, wherein said whiskers come into contact with each other to form a mesh-like heat generator structure.

22. A microwave oven according to claim 17, wherein said zinc oxide whiskers have a resistivity of from $10^2$ to $10^6\Omega\cdot$cm.

23. A microwave oven according to claim 17, wherein said heat-generating material is comprised of zinc oxide whiskers and a heat-resistant material.

24. A microwave oven having a heating chamber with heating container provided within said heating chamber, said heating container comprising zinc oxide whiskers dispersed in a matrix, said zinc oxide whiskers being not less than 10 μm in length from a base portion of each whisker to a top portion of each whisker and having a resistivity of from 10 to $10^8\Omega\cdot$cm, and said matrix being at least one selected from the group consisting of ceramics, glasses, enamels, resins, rubbers, organic coating materials, inorganic coating materials, clay, mica, sand, earthenware, porcelain, water and oil.

25. A microwave oven according to claim 24, wherein said heat-generating material is comprised of zinc oxide whiskers and a structural material from which said container is formed.

* * * * *